US005168578A

United States Patent [19]

Stanley

[11] Patent Number: 5,168,578

[45] Date of Patent: Dec. 8, 1992

[54] ANTI-JAM GLOVE

[75] Inventor: Carol A. J. Stanley, Collingswood, N.J.

[73] Assignee: Stash, Inc., Collingswood, N.J.

[21] Appl. No.: 807,059

[22] Filed: Dec. 6, 1991

[51] Int. Cl.[5] ..... A41D 13/10

[52] U.S. Cl. ..... 2/19; 2/20

[58] Field of Search ..... 2/20, 19, 161 A, 163, 2/161 R, 159, 160, 164, 16; 273/26 C

[56] References Cited

U.S. PATENT DOCUMENTS 4,709,694 12/1987 O'Connell ..... 2/167 X

*Primary Examiner*—Andrew M. Falik
*Assistant Examiner*—Sara M. Current
*Attorney, Agent, or Firm*—Eugene E. Renz, Jr.

[57] ABSTRACT

A glove device for use in swinging a baseball bat and the like, including a back portion and palm portion joined together to form a hand conforming glove. Also included are digital sheaths attached to the glove and aligned to cover at least a portion of at least the thumb and the index finger. The device has a control spacer forming part of the palm and the digital sheaths, and has sufficient thickness to shift control over gripping a bat to the remaining fingers of the hand.

5 Claims, 2 Drawing Sheets

ANTI-JAM GLOVE

FIELD OF THE INVENTION

The present invention relates to a glove device for use in playing baseball, and more particularly to gloves which assist the batter in hitting a baseball.

BACKGROUND OF THE INVENTION

Ball gloves first became used in baseball soon after the game was invented. As the ball became hard and evolved into present "hardball" form, fielders began to use gloves both for protection of the fingers and palm and also to assist in gathering a batted or thrown ball into the pocket of the glove.

Much later in baseball history baseball batters began to use gloves. Initially, rosin was use to increase frictional griping of the bat, to prevent slippage and increase control. As lighter bats and harder pitching combined with the trend for players to conserve their hands and prolong their career, padded gloves specifically for batting have been developed. Padded gloves offer protection against tissue damage and bone contusion, and the prior art has addressed that issue.

Rector U.S. Pat. No. 4,071,913 offers a protective device which covers the entire hand including the fingers and wrist with a leather glove. Padding is provided at the finger tips, the palmar surface of the thumb, and the palmar skin from the wrist to the base of the fingers. (Other devices which cover the entire hand include for Hirschfield U.S. Pat. No. 4,121,824; Elliott U.S. Pat. No. 4,042,975; Barden U.S. Pat. No. 1,797,116, and Madnick U.S. Pat. No. 3,267,486, respectively.

An other protective device covers by means of flexible padded tubing with a thumb hole, the palmar and dorsal areas from the wrist to the roots of the fingers. (See Goebel U.S. Pat. No. 4,176,407.) This device is similar to the fingerless glove which leaves each digit completely exposed, such as in Kohler U.S. Pat. No. 425,887.

A third device covers a portion of each proximal phalanx or finger bone in addition to covering the metacarpal area of the hand. See Rawlings U.S. Pat. No 325,968; Dimitroff U.S. Pat. No. 3,606,614; Stansberry et al U.S. Pat. No. 3,501,773; DeMarco U.S. Pat. No. 4,183,100 and Toccoli U.S. Pat. No. 2,465,136 respectively, as illustrating examples of this device. All of these devices effectively cushion the hand but substantially reduce or impede the ease and the effectiveness of griping the bat.

One other device which has met with commercial success is described in U.S. Pat. No. 4,561,122. In this device, concern for the ability of the human hand to experience "tactilegnosis" or the unique phenomenon of cognizance-by-touch in which in the hand can "see" what it is doing without the aid of the eye. In this patent, a glove is provided which has shock absorbent material, for baseball or other activities, so that the digital sheaths which have the padding expose the distal phalanx that extend to cover the proximal interphalangeal joint, or its first digit equivalent. The glove has other features but its primary purpose it to provide touch or feel by exposing the tips or the ends of the fingers while protecting that portion of the hand which receives the shock. It is noted that the patent explicitly provides for padding over the entire area of the hand as evenly as possible to preserve the characteristic curve of the hand and preserve its ability to grasp the bat, for example, by wrapping the hand around the handle of the bat.

All of these prior art gloves are primarily concerned with padding various portions of the ball players hand so that tissue and bone damage is minimized or eliminated. Other than providing a dry surface for griping the bat, possibly with a leather or synthetic material which is dryer or has less slipperiness than the bare palm of the hand, none of these glove products have a positive effect upon the ability of the batter to hit the ball. With all of the above described prior art designs, there is a loss of "feel" in controlling the bat. More importantly, however, is the fact that the padding and the like causes a slower bat, so that a fast ball is harder to hit. In baseball jargon, it is easier to "jam" the batter with a "high hard one." With advent of the fast slider the need for a batter to wait before swinging is even greater although the time given to the batter to swing is less because of the higher velocity of the pitch. Accordingly, the use of a glove or gloves with padding producing a slower swing of the bat is counterproductive.

Accordingly, it is object of this invention to provide a glove device which does not slow or reduce the ability of the batter to swing the bat.

More particularly, it is an object of this invention to provide a glove device which in fact increase the speed of the swing to provide a quicker bat.

Other objects will appear hereinafter.

SUMMARY OF THE INVENTION

It is now been discovered that the above and other objects of the present invention may be accomplished in the following manner. Specifically, an improved glove device for use in swinging a baseball bat been discovered which increases the speed at which a batter can swing a baseball bat.

The glove device of the present invention includes a back portion and a palm portion joined together to form a hand conforming glove. Digital sheaths are attached to the glove and are aligned to cover at least a portion of at least the thumb and index finger. A control spacing means is formed as part of the palm portion and the digital sheaths. The control spacing means has sufficient thickness to shift control over gripping a bat to the remaining fingers of the hand.

In a preferred embodiment, the control spacing means extends from a point proximate the joint on the user's thumb to a point proximate the metacarpophalangeal joint of the index finger. Preferably, the thickness of the control spacing means is sufficient to absorb shock and to prevent bruising of the user's hand when the bat makes contact with a baseball. In one embodiment, the device will include five (5) full finger digital sheaths. In another preferred embodiment, the last three (3) fingers are sheathed only to the first knuckle.

It is essential for the purposes of this invention that the padding in the control spacing means function to prevent squeezing of the bat with the index finger and adjust the gripping of the bat to the last three (3) fingers. It has been discovered herein that the batter's fine motor skills and control of the bat are greater when the muscles of the fingers rather than of the arms are used to control the bat.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 2:
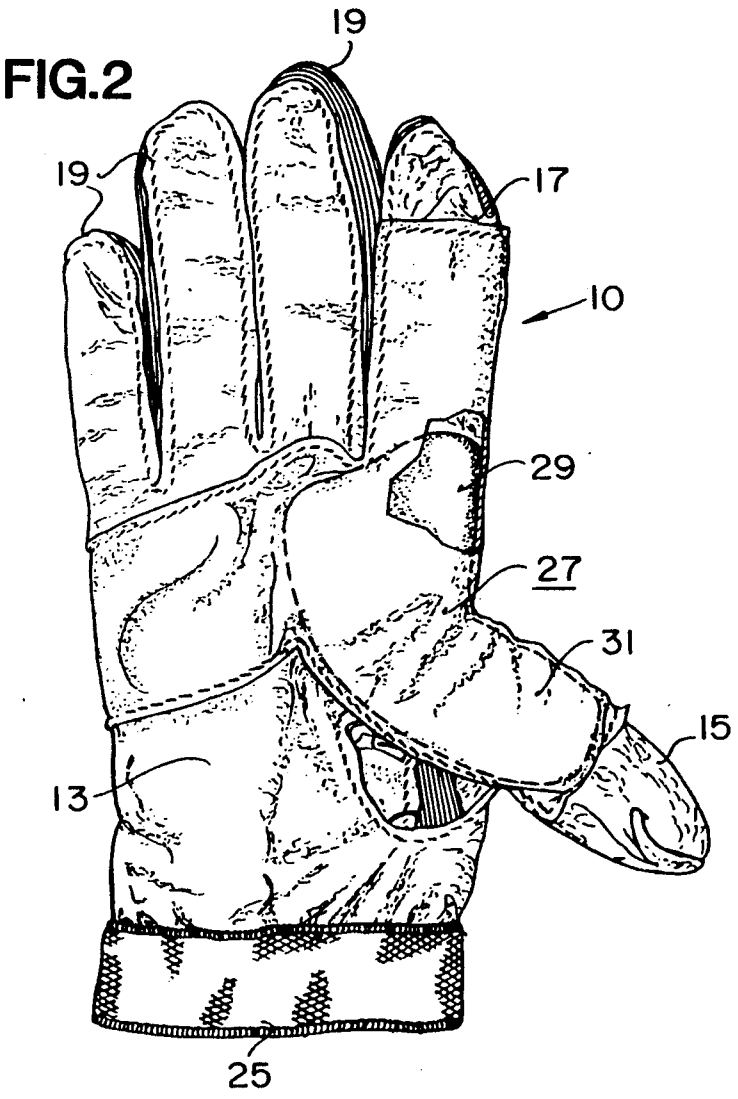
FIG. 2 is a plan view of the palm side of the glove device shown in FIG. 1, with a small portion broken away and in section to show the padding insert.

The device of the present invention, shown generally by the reference numeral 10, includes a back or dorsal portion 11 and a palm or front portion 13, which are joined together to form a hand conforming glove. In a preferred embodiment, back portion 11 palm portion 13 contain no padding other than described below relating to the control spacing feature of the present invention.

Extending from the glove formed by back portion 11 and palm portion 13 is a thumb sheath 15, and index finger sheath 17 and other finger digital sheaths 19. The thumb sheath 15 and index finger sheath 17 cover at least up to point proximate the joint on the user's thumb and at least up to a point proximate the metacarpophalangeal joint of the index finger.

Figure 1:
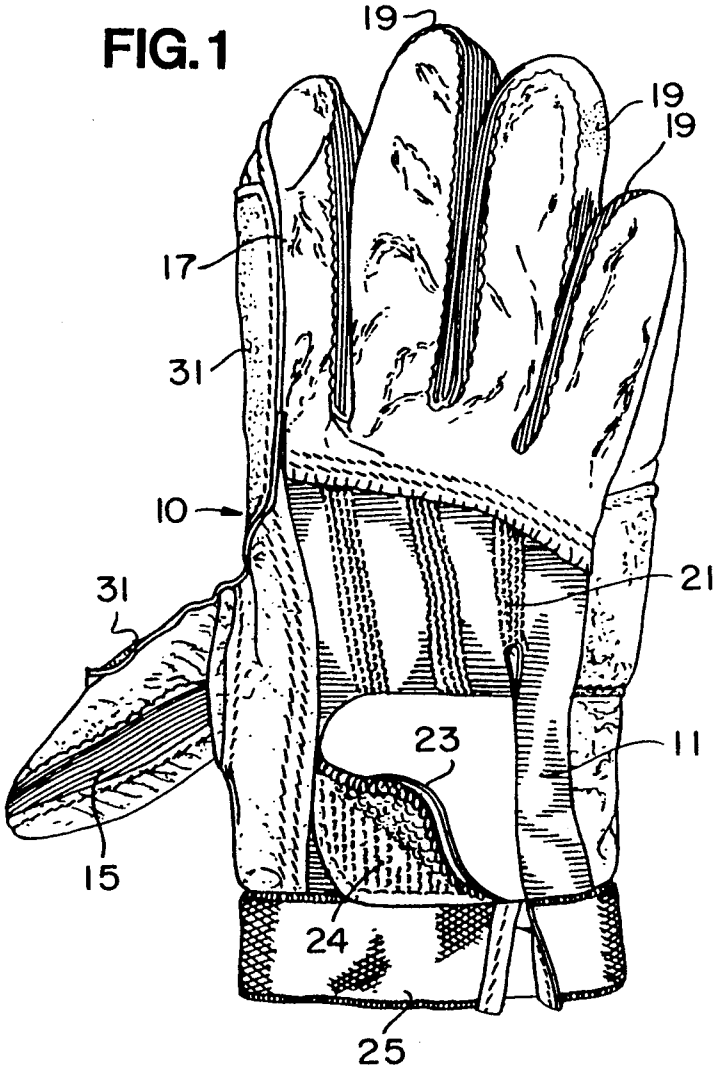
FIG. 1 is a plan view of the dorsal side of a right hand glove device of the present invention.

The back side or dorsal side of the batters glove shown in FIG. 1 also shows a portion of porous netting 21 so that the glove can breathe and keep the hand cooler. The conformity of the glove to the hand is facilitated by a fastening tab 23 and patch 24. Wrist band 25 completes glove and allows for freedom of movement while the glove conforms to the hand.

Turning now to FIG. 2, a controlled spacing means 27 is formed as part of the palm portion and the thumb and index finger sheaths. Padding 29 is provided inside the spacing means 27 having sufficient thickness to shift control over gripping a bat to the remaining three (3) fingers of the hand as will be described hereinafter. Enclosing the padding is a leather cover 31 which extends up to a point approximate the joint on the thumb and to a point approximate the metacarpophalangeal joint of the index finger. Leather cover 31 also extends across the palm around to the dorsal side of the glove to provide a uniform wear resistant surface for contact with the bat.

Figure 3:
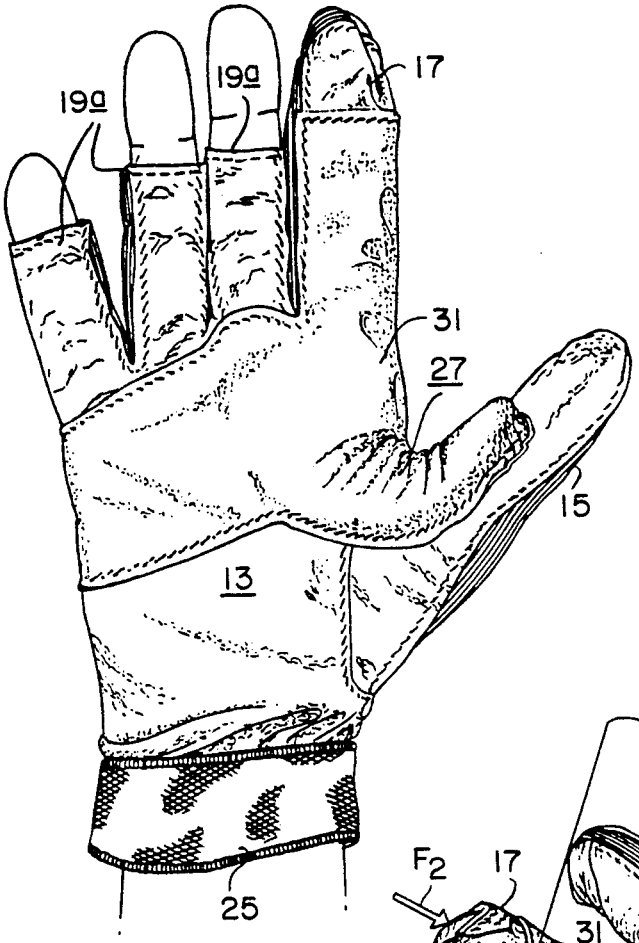
FIG. 3 is a plan view of the palm side of the glove device according to the present invention with a second embodiment showing exposed finger tips for the back three (3) fingers of the hand.
Figure 4:
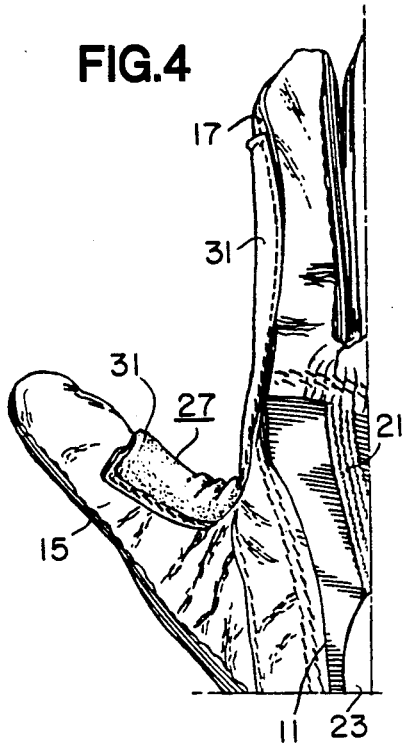
FIG. 4 is a fragmentary plan view of the dorsal side of the device shown in FIG. 3, fitted with a hand.
Figure 5:
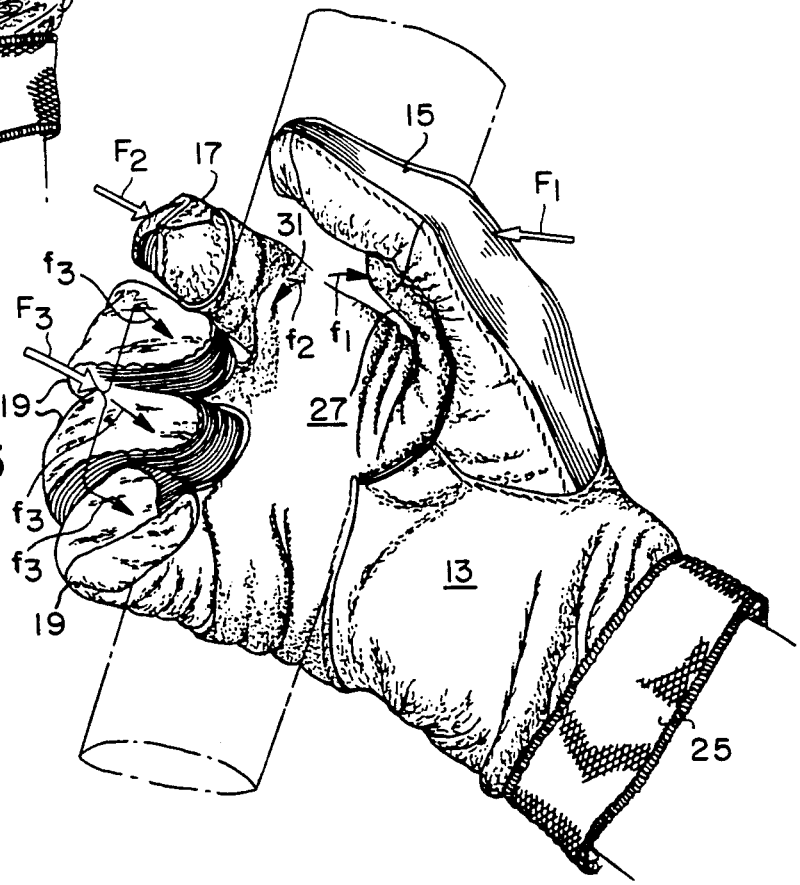
FIG. 5 is a perspective view showing the device of the present invention in which a player is gripping a baseball bat, shown fragmentary in dot and dash lines.

Turning now to FIG. 3 an alternative embodiment is shown in which the digital sheaths 19*a* covering the middle finger, ring finger and little finger of the hand terminate so that the ends of the fingers are available for improved "feel" and control. Also, can be seen FIGS. 3 and 4, the leather cover 31 does not contain padding except in the area where the bat would be gripped by the thumb and index finger.

It is believed that the key to successful hitting in major league baseball is to control the bat with the last (3) three fingers of the hand, rather than with the index finger and thumb. Fine motor skills and control of the bat is greater when the muscles in the fingers are used rather than the muscles of the arms. Control spacing means 27 forces the hand to grip the bat with these fine motor skill muscles and, additional, absorbs shock at the point of greatest vulnerability, namely the region between thumb and index finger. The key to hitting is to hit with the writing muscles rather with the fighting muscles. Thus, when a fast ball or a hard slider is thrown at speeds of greater than 90 mph, the batter is able to see the pitch for fraction of the second longer and then swing with greater bat speed, increasing the likelihood of a good connection in resulting in a hit.

In order to demonstrate the efficacy of the present invention several batters of varying skills were asked to wear gloves made according to the present invention. Several batters were asked to use the glove without being told what the purpose of the special control spacing means was. Within the limits of human reproducability, each of those batters attempting to hit fast balls acknowledge that their swing felt faster. After the concept of the present invention were explained, attempts by these experimental batters to augment and frustrate the concept of this invention where made, resulting in a consensus that the glove device of the present invention gave the hitter a quicker bat and reduced the likelihood that a properly thrown fastball would jam the batter and prevent contact from being made.

While particular embodiments of the present invention have been illustrated and described herein, it is not intended to limit the invention. Changes in modifications may be made therein within the scope of the following claims.

What is claimed is:

1. A glove device for use in swinging a baseball bat comprising:

a back portion and palm portion joined together the form a hand conforming glove;

digital sheaths attached to said glove and aligned to cover at least a portion of at least the thumb and the index finger of the hand; and control spacing means forming part of said palm portion and said digital sheaths, and having padding of sufficient thickness to shift control over gripping a bat to the last three fingers of the hand to thereby increase the speed potential of a swing.

2. The device of claim 1, wherein said control spacing means extends from a point proximate the joint on a user's thumb to a point proximate the metacarpophalangeal joint of the index finger.

3. The device of claim 1, wherein the thickness of said spacing means is sufficient to absorb shock to prevent bruising of a user's hand upon hitting a baseball.

4. The device of claim 1, which includes five full finger digital sheaths.

5. The device of claim 1, which includes cut off digital sheaths for the remaining three fingers to leave at least ends of the fingers exposed.

* * * * *